US005379048A

United States Patent [19]

Kaufman

[11] Patent Number: 5,379,048

[45] Date of Patent: Jan. 3, 1995

[54] AUTOMATIC ANTENNA TILT APPARATUS

[75] Inventor: Stephen R. Kaufman, Georgetown, Tex.

[73] Assignee: The Electro-Mechanics Company, Austin, Tex.

[21] Appl. No.: 101,635

[22] Filed: Aug. 4, 1993

[51] Int. Cl.[6] ..... H01Q 3/00

[52] U.S. Cl. ..... 343/765; 343/703; 248/183

[58] Field of Search ..... 343/703, 757, 758, 765, 343/766, 878, 882; 248/183, 913; H01Q 3/00, 1/12, 3/08

[56] References Cited

U.S. PATENT DOCUMENTS

| | | | |
|---|---|---|---|
| 4,201,987 | 5/1980 | Tricoles et al. | 343/703 |
| 4,295,621 | 10/1981 | Siryj | 343/765 |
| 4,931,809 | 6/1990 | Putman et al. | 343/878 |
| 5,149,029 | 9/1992 | Smith | 248/183 |

*Primary Examiner*—Donald Hajec
*Assistant Examiner*—Tan Ho
*Attorney, Agent, or Firm*—W. B. Ritchie

[57] ABSTRACT

An automatic tilt apparatus for use with electromagnetic emission testing devices. The apparatus enables the user to always bore-sight, that is, to point the antenna directly at the object being tested regardless of the height of the antenna. The apparatus utilizes a cam plate to achieve automatic tilting. A threaded rod, connected to the vertical drive mechanism of the testing device converts the rotary motion of the sprocket drive to a horizontal motion. The threaded rod is located within a boom that connects to the testing device. The linear, horizontal motion of the threaded rod causes a first bolt within a slot of the boom to move. A cam plate is attached to the carrier boom via the first bolt and a second bolt which is fastened through an arcuate slot in the cam. The motion of the first bolt causes the second bolt to follow the geometry of the acrucate slot, thus causing The cam plate to tilt in accordance with the vertical height of the testing device. An antenna boom and attached antenna will thus also point at the object being tested regardless of the vertical position of the testing device. Non-metallic materials are used throughout in order to avoid perturbing the electromagnetic field. Cam plates for testing devices uses different test heights can be easily removed and installed.

5 Claims, 4 Drawing Sheets

AUTOMATIC ANTENNA TILT APPARATUS

BACKGROUND OF THE INVENTION

1. Field of the Invention

The invention relates to mechanisms for automatically adjusting the angle of an antenna used for testing electromagnetic emissions.

2. Description of the Related Art

With ever increasing numbers and variations of electronic equipment capable of producing excessive electromagnetic emissions, the need for efficient and accurate testing to determine which units meet or exceed standards set by the American National Standards Institute (ANSI). ANSI regulations require that the antenna be kept within the cone of radiation being emitted from the Electronic Unit Tested (EUT) and pointed at the area of highest emission of the EUT both in azimuth and elevation, with polarization oriented for maximum response.

While present antenna mounting units are capable of automatically adjusting the height of the antenna mounting boom relative to the EUT, none provide for automatically tilting the antenna for the required test height to meet the requirement as set forth in ANSI C63.4.

SUMMARY OF THE INVENTION it is an object of the invention to provide a tilt apparatus for automatically adjusting the angle of an antenna for any required test height-test distance combination.

It is another object of the invention to provide an automatic tilt mechanism which employs non-metallic drive components.

It is a further object of the invention to provide an automatic antenna tilt apparatus that meets ANSI testing requirements as defined in C63.4.

It is still another object of the invention to provide an automatic tilt apparatus that can easily be adjusted to accommodate different test distances and heights.

The invention is an automatic antenna tilt apparatus for an electromagnetic emission testing device for testing at a pre-selected distance, said device having a vertical drive mechanism with a sprocket to raise and lower said testing device to pre-determined height. Tilt drive means is provided. Tilt drive means is connected to said drive mechanism of said testing device. Tilt drive means changes the motion provided by the drive mechanism of said testing device into horizontal motion. A carrier boom is provided. The carrier boom has a horizontal slot and a first pivot bolt therethrough, with said bolt cooperating with said tilt drive means such that horizontal motion of said tilt drive means causes said first pivot bolt to correspondingly move in said horizontal slot, A cam plate is provided. The cam plate has an arcuate-shaped slot with said slot dimensioned to correspond to the pre-selected test distance and the test height of said testing device. The cam plate is pivotally attached to said carrier boom via said first pivot bolt and a second pivot bolt through the arcuate slot in said cam plate; wherein the horizontal motion of said first pivot bolt causes said second pivot bolt to move within the arcuate slot in said cam plate whereby said cam plate tilts corresponding to the vertical height of vertical drive mechanism.

DETAILED DESCRIPTION OF THE INVENTION

As noted above, the ability to bore-sight antennas during the test procedure is highly desirable. Bore-sight is defined as the ability to point a test antenna directly at an object under test no matter what its height. This goal has been difficult to achieve because the necessary drive components must remain largely non-metallic so as not to perturb the electromagnetic field. An ability to bore-sight height adjustable antennas with non-metallic tilt mechanisms would allow directionally sensitive antennas with narrow beam-widths such as log-periodic and horn antennas to be used to a greater extent in electromagnetic interference testing. Automatic antenna tilt mechanisms relying on non-metallic drive components are advantageous since the likelihood of electromagnetic coupling between the electromagnetic field propagated by the antenna and the non-metallic tilt mechanism is minimized. A non-metallic tilt mechanism would enable the maximum amount of electromagnetic energy to be coupled into a narrow beam-width antenna, thus enabling the antenna to more accurately follow a test object during height changes.

Figure 1:
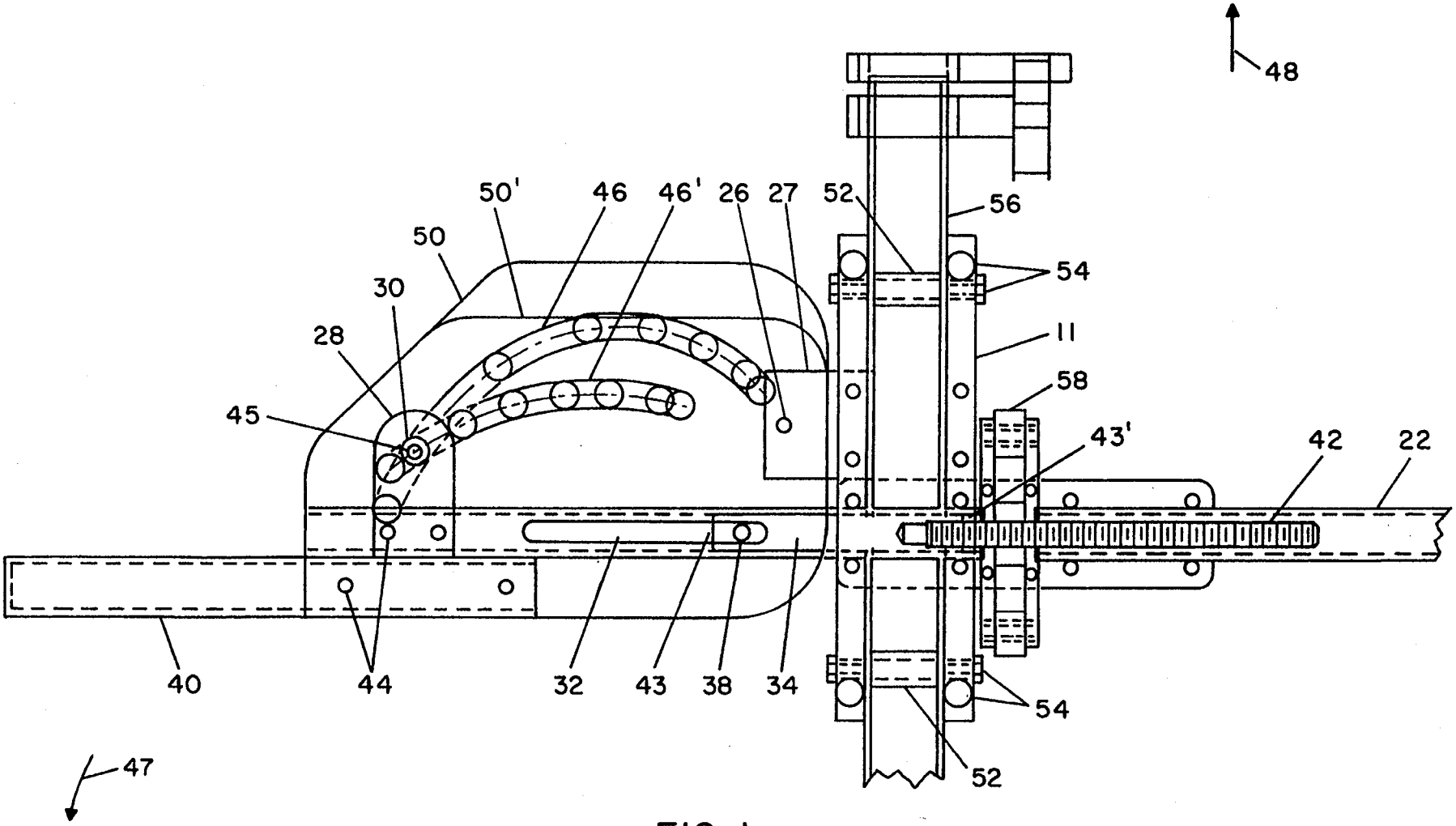
FIG. 1 is a composite front side view of the automatic antenna tilt mechanism in accordance with the invention.

FIG. 1 is a composite front side view of the automatic antenna tilt mechanism in accordance with the invention. Carrier 11 is fastened to mast 56. Mast 56 is preferably a 3" by 3" fiberglass tube. Carrier 11 is moveably attached to mast 56 via nylon bolts 54 and non-metallic rollers 52. In this manner, carrier 11 is free to easily slide up and down mast 56.

Carrier 11 is driven by timing belt (not shown). The specifications for the timing belt, and other parts of the drive mechanism of the invention provided herein are only one set of a variety of combinations that would also work. This belt is preferably a polyurethane, KEVLAR re-inforced, 10 mm pitch belt that is commercially available. The timing belt engages sprocket 58. Sprocket 58 is preferably has 16 teeth with a 10 mm pitch.

All structural parts of the invention that would be within the electromagnetic field during testing are either delrin, nylon, teflon or other suitable non-metallic material.

The rotary motion of sprocket 58 is translated into horizontal motion via threaded actuator rod 42. Rod 42 is preferably an 8 pitch.

Rod 42 is located within carrier boom 22. Boom 22 is preferably a square fiberglass tube. However, other shapes and material would also be acceptable as long as The non-metallic requirement was met. Boom 22 is rigidly attached to carrier 11 via bolts. inside boom 22 attached to rod 42 is actuator bracket 34. Actuator bracket is a square block designed with slide within boom 22. Actuator bracket 34 extends from end 43' which is to the right of the left end of rod 42 to end 43 which is to the left of bolt 38 as viewed in FIG. 1. Bolt 38 is also attached to bracket 34. Boom 22 is pivotly attached to cam plate 50 via cam bolt 45 which is fastened through bracket 28 and bolt 38. Cam plate 50 can be PLEXIGLAS, LEXAN or other plastic, preferably about ½ inch thick.

Cam plate 50 has through slot 46 located therein. Slot 46 is empircally derived. First, a test distance is selected. The current common test distances are 3,10 and 30 meters. Then, carrier 11 is raised slightly. The point at which plate 50 would have to be moved if an attached boom would point at an object located at the test distance is then marked on plate 50. Carrier 11 is again raise slightly and the procedure is repeated throughout the range of height that carrier will travel. Typical test heights for this type of testing is 4 meters, however, a 6 meter capability is preferred in the event that extra height may be required.

The points marked on plate 50 are then connected by a smooth line and slot 46 is cut which then corresponds to the pre- selected distance over the range of tests heights that will be utilized. A new plate is required for each test distance. Plate 50 and slot 46 correspond to a 3 meter test distance situation. That is, when carrier 11 is raised to its maximum height, that is, the direction indicated by arrow 48, antenna boom 40 will tilt in the direction of arc 47 so that antenna boom 40 will always point at the target at a test distance of 3 meters, regardless of the location of carrier 11 within the test height range.

Figure 2:
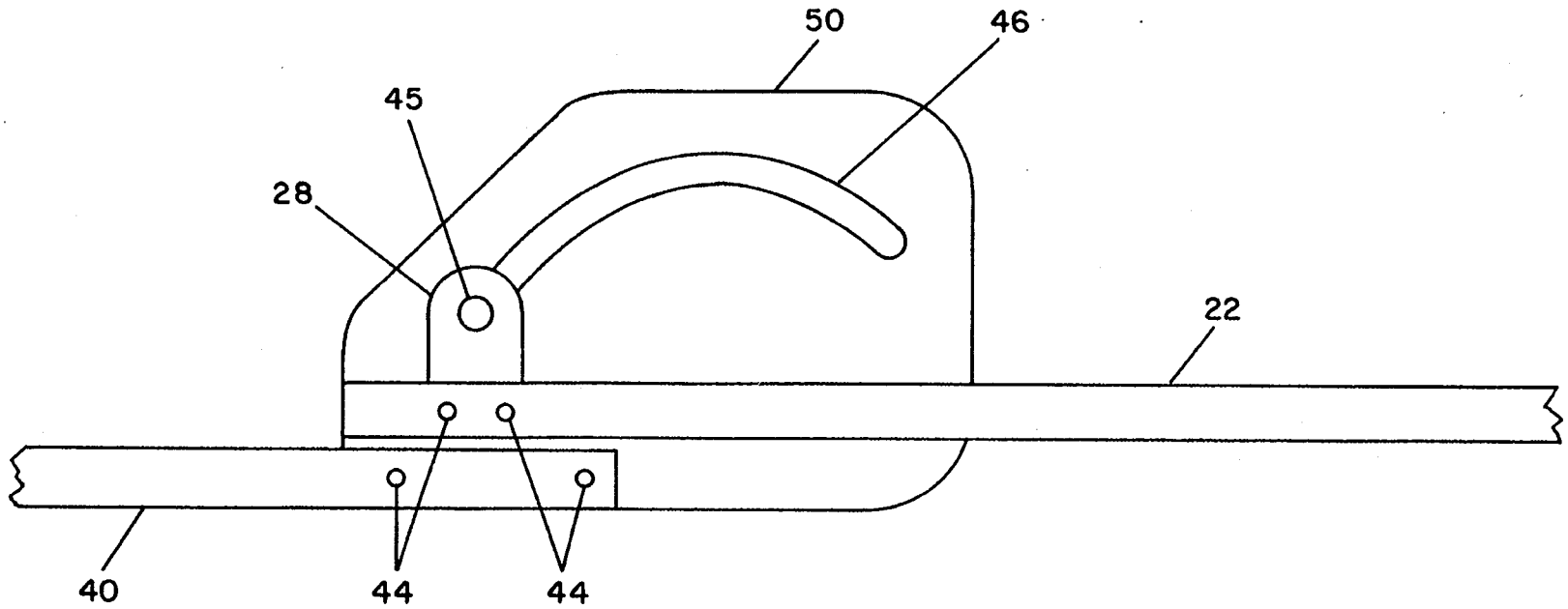
FIG. 2 is a front side view showing the cam plate and the attached carrier and antenna booms.

Cam plate 50' and slot 46' show the configuration for a 10 meter situation. Only one cam plate is placed on the invention at a time as shown in FIG. 2. FIG. 2 is a front side view showing cam plate 50, the 3 meter cam, and pivotly attached carrier 22 and rigidly attached antenna boom 40. As shown, carrier boom 22 is attached to bracket 28 via bolts 44. Bolts 44 are preferably nylon but other plastics could also be substituted. Similarly, bolts 44 are used to rigidly attached antenna boom 44 to cam plate 50.

Figure 3:
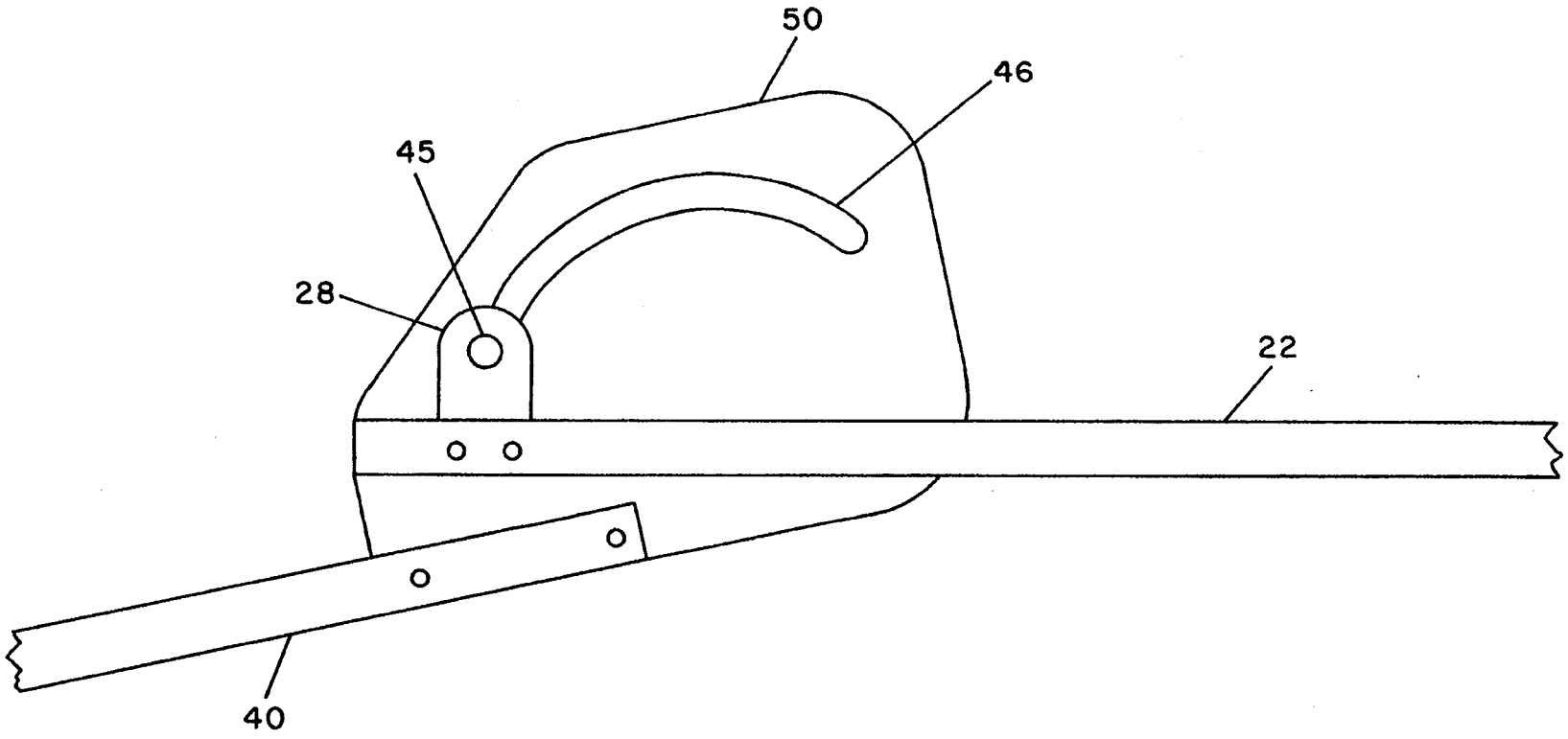
FIG. 3 is a front side view showing the cam plate and the attached carrier and antenna booms in a tilted position.
Figure 4:
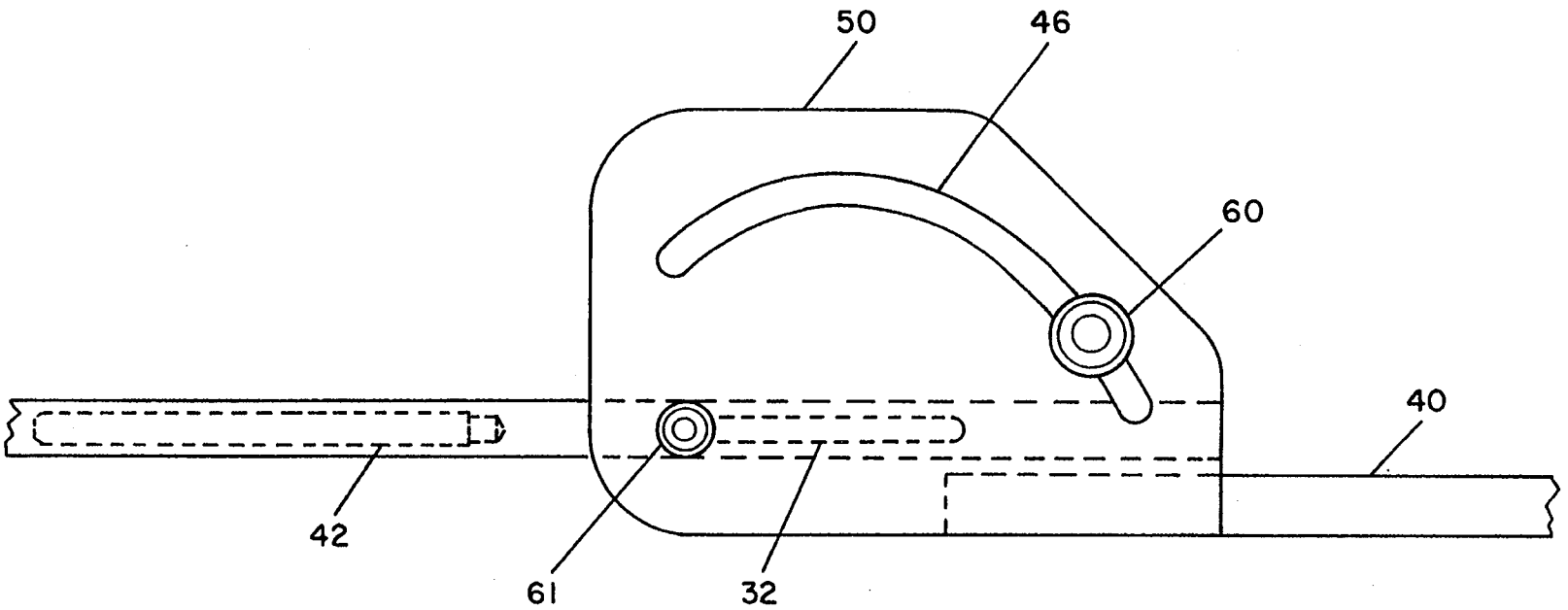
FIG. 4 is a rear side view showing the cam plate and attached carrier and antenna booms.

Referring now to FIGS. 1,3 and 4, the tilting operation of the invention is achieved by threaded rod 42 which turns when sprocket 58 engages the timing belt (not shown). Rod 42, attached to bracket 34 is urged against cam bolt 38. The horizontal motion of bracket 34 and attached bolt 38 causes bolt 38 to slide in slot 32 located in boom 22. Slot 32 is located in the surface of boom 22 that is adjacent to cam plate 50. As bolt 38 slides in slot 32, cam bolt 45 correspondingly is forced to follow cam slot 46 upwardly which causes antenna boom 40 to automatically tilt downward following arc 47 as carrier 11 moves upward in the direction of arrow 48 as shown in FIG. 3. If cam bolt 38 is removed and placed in opening 26 of block 27, boom 22 will remain parallel to the ground as carrier 11 moves upward in the direction of arrow 48.

Knobs 60 and 61 are used to releasably attach cam plate 50 and its attached antenna boom 40 to carrier boom 22. Knob 60 uses a roller bushing so that it will allow plate 50 to move smoothly. Knob 61 preferably has an elastomer spring to provide tension to hold plate 50 in place. Also, quickly changing to a different size of cam plate is accomplished by loosening knobs 60 and 61, removing cam plate 50, and quickly installing a different size cam plate and its attached carrier boom 40.

While what has been described is at present considered to be the preferred embodiment of this invention, it will be obvious to those skilled in the art that various changes and modifications may be made without departing from the invention and it is, therefore, aimed to cover all such changes and modifications as fall within the true spirit and scope of the invention.

What is claimed is:

1. An automatically antenna tilt apparatus for an electromagnetic emission testing device for testing at a pre-selected distance, said device having a vertical drive mechanism with a sprocket to raise and lower said testing device to pre-determined height, said apparatus comprising:

tilt drive means, connected to said drive mechanism of said testing device, for changing the motion provided by the drive mechanism of said testing device into horizontal motion;

a carrier boom, having a horizontal slot and a first pivot bolt therethrough, with said bolt cooperating with said tilt drive means such that horizontal motion of said tilt drive means causes said first pivot bolt to correspondingly move in said horizontal slot;

a cam plate having an arcuate-shaped slot with said slot dimensioned to correspond to the pre-selected test distance and test height of said testing device, with said cam plate pivotally attached to said carrier boom via said first pivot bolt and a second pivot bolt through the arcuate slot in said cam plate; wherein the horizontal motion of said first pivot bolt causes said second pivot bolt to move within the arcuate slot in said cam plate whereby said cam plate tilts.

2. The antenna tilt apparatus of claim 1 wherein said cam plate further comprises an attached antenna mounting boom such said antenna boom always points directly at an object being testing using emission testing device.

3. The antenna tilt apparatus of claim 2 wherein said first and second pivot bolts are removeable by hand such that said cam plate can be easy changed for another having a slot corresponding to a different height.

4. The antenna tilt apparatus of claim 3 wherein said tilt drive means further comprises:

a threaded rod connected to the sprocket of the vertical drive mechanism;

a bracket connected to said threaded rod, with said bracket engaging said first pivot bolt such that when vertical drive mechanism is activated, said threaded rod and attached bracket cause said first pivot bolt to move within the horizontal slot of said carrier boom.

5. The antenna tilt apparatus of claim 4 wherein all parts of said apparatus are non-metallic materials.

* * * * *